United States Patent [19]

Aufdembrink et al.

[11] Patent Number: 4,895,638

[45] Date of Patent: Jan. 23, 1990

[54] CATALYTIC CRACKING PROCESS

[75] Inventors: Brent A. Aufdembrink, Wilmington, Del.; Thomas F. Degnan, Yardley; Charles T. Kresge, West Chester, both of Pa.

[73] Assignee: Mobil Oil Corporation, New York, N.Y.

[21] Appl. No.: 339,284

[22] Filed: Apr. 17, 1989

Related U.S. Application Data

[63] Continuation-in-part of Ser. No. 139,520, Dec. 30, 1987, abandoned.

[51] Int. Cl.[4] ..... C10G 11/04

[52] U.S. Cl. ..... 208/118; 208/119; 208/120; 208/121; 208/122; 208/123; 208/124

[58] Field of Search ..... 208/113, 118, 119, 120, 208/121, 122, 123, 124

[56] References Cited

U.S. PATENT DOCUMENTS

| | | | |
|---|---|---|---|
| 4,151,123 | 4/1979 | McCann | 502/303 |
| 4,248,739 | 9/1981 | Vaughan et al. | 423/328 |
| 4,510,257 | 4/1985 | Lewis et al. | 502/63 |
| 4,600,503 | 7/1986 | Angevine et al. | 208/251 H |
| 4,613,584 | 9/1986 | Schneider | 423/648.1 |
| 4,629,713 | 12/1986 | Suzuki et al. | 502/84 |
| 4,637,991 | 1/1987 | Battise et al. | 502/68 |
| 4,637,992 | 1/1987 | Lewis et al. | 502/84 |
| 4,650,779 | 3/1987 | Goldstein | 502/38 |
| 4,831,005 | 5/1989 | Aufdembrink | 502/242 |
| 4,831,006 | 5/1989 | Aufdembrink | 502/242 |

FOREIGN PATENT DOCUMENTS

| | | | |
|---|---|---|---|
| 0205711 | 12/1986 | European Pat. Off. | 502/242 |
| 8800090 | 1/1988 | PCT Int'l Appl. | 502/242 |
| 2071071 | 9/1981 | United Kingdom | 502/84 |

*Primary Examiner*—Anthony McFarlane
*Attorney, Agent, or Firm*—Alexander J. McKillop; Charles J. Speciale; Edward F. Kenehan, Jr.

[57] ABSTRACT

A process for the catalytic cracking of heavy petroleum fractions into lower hydrocarbons, such as fuel products. The process comprises contacting the petroleum fractions at an elevated temperature with a cracking catalyst comprising (a) a layered metal oxide of the titanometallate type intercalated with an interspathic polymeric chalcogenide, e.g., polymeric silica and, optionally (b) a porous crystalline silicate component such as a large pore zeolite material.

25 Claims, 4 Drawing Sheets

CATALYTIC CRACKING PROCESS

CROSS REFERENCE TO RELATED APPLICATIONS

Figure 1:
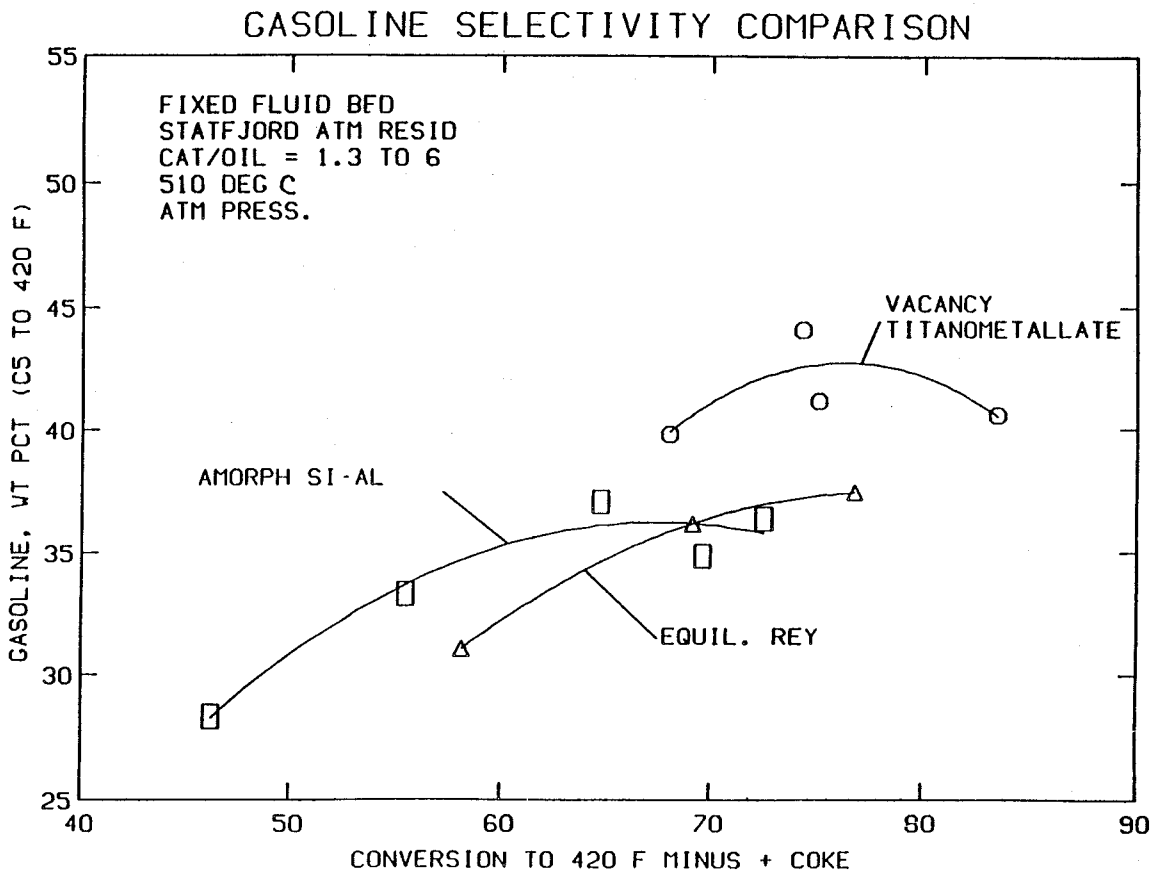

This application is a continuation-in-part of copending U.S. application Ser. No. 139,520, filed Dec. 30, 1987, now abandoned.

This application is also related to application No. PCT/US87/01444, filed June 11, 1987 now pending, which is a continuation-in-part of U.S. Ser. No. 879,787, filed June 27, 1987, now U.S. Pat. No. 4,859,648, which in turn is a continuation-in-part of U.S. Ser. No. 687,414, filed Dec. 28, 1984, now abandoned, the entire contents of each being incorporated herein by reference.

BACKGROUND

The present invention relates to processed for the catalytic cracking of heavy petroleum fractions so as to produce lighter hydrocarbon products such as fuel products. More particularly, the invention relates to a process for the catalytic cracking of heavy petroleum fractions which utilizes a catalyst comprising (a) a layered metal oxide of the titanometallate type intercalated with an interspathic polymeric chalcogenide, e.g., polymeric silica and, optionally (b) a large pore porous crystalline silicate component such as a large pore zeolite.

The conversion of various petroleum fractions by catalytic cracking so as to reduce the molecular weight of the contained hydrocarbons is well known in the art. In such a conversion, a petroleum fraction based feedstock is brought into contact with a particulate catalyst under appropriate condition such as elevated temperatures (e.g., at least 400° C.) so as to convert the feedstock into a variety of products which, upon fractionation and the like, yield one or more of gas, gasoline, light cycle gas oil and heavy cycle gas oil. Much of the petroleum refining industry utilizes a fluid bed catalytic cracking reactor for this purpose. Such a reactor typically comprises a thermally balanced assembly of apparatus comprising the reactor vessel containing a mixture of regenerated catalyst and the feedstock and a regenerator vessel wherein spent catalyst is regenerated. As the feedstock is converted in the reactor vessel over the catalyst, coke is simultaneously formed on the catalyst, thereby deactivating the same. The deactivated (spent) catalyst is removed from the reactor vessel and then conducted to a regenerator vessel, where coke is burned off the catalyst with air, thereby regenerating the catalyst which is then recycled to the reactor.

Conventional catalysts used in catalytic cracking are, for example, those containing silica, silica-alumina or mixtures thereof. Particularly useful catalysts are acidic zeolites, preferably low coke-producing crystalline zeolite cracking catalysts comprising faujasite, and other zeolites known in the art. Typically, the catalyst is of fine particles having an average size of about 20 to 100 microns.

While the above catalysts have been generally satisfactory for their intended use in catalytic cracking operations, it has now been found that enhanced catalytic cracking can be achieved by utilizing a catalyst containing (a) a layered metal oxide of the titanometallate-type intercalated with an interspathic polymeric chalcogenide, and optionally, (b) a large pore porous crystalline silicate component such as a zeolite material.

More particularly, the titanometallate-type layered metal oxide product comprises a layered metal oxide and pillars of a chalcogenide of at least one element selected from Groups IB, IIB, IIIA, IIIB, IVA, IVB, VA, VB, VIA, VIIA and VIIIA of the Periodic Table of the Elements (Fisher Scientific Co. Cat. No. 5-702-10, 1978) separating the layers of the metal oxide, wherein each layer of the metal oxide has the general formula $$[M_x[]_yZ_{2-(x+y)}O_4]^{q-}$$

wherein M is at least one metal of valence n wherein n is an integer between 0 and 7 and preferably is 2 or 3, []represents a vacancy site, Z is a tetravalent metal, preferably titanium, and wherein $$q=4y-x(n-4) \text{ and preferably is 0.6–0.9,}$$
$$O<x+y<2$$

The metal oxide product contains about 0.5 to about 20 weight percent of said element M, preferably about 1 to 10 weight percent.

The intercalated titanometallate-type layered metal oxide product employed in the present invention comprises a layered titanometallate-type layered metal oxide and interspathic polymeric chalcogenide of at least one element, separating the layers of the metal oxide. Preferably, such materials after pillaring are thermally stable, i.e., capable of withstanding calcination at a temperature of about 450° C. for at least 2 hours without significant reduction (e.g., not greater than 10 or 20%) in the spacing between the layers.

It is to be appreciated that the term "layered" metal oxide is used herein in its commonly accepted sense to refer to a material which comprises a plurality of separate metal oxide layers which are capable of being physically displaced away from one another such that the spacing between adjacent layers is increased. Such displacement can be measured by X-ray diffraction techniques and/or by density measurements.

For purposes of the present invention the term "chalcogenide" includes members of the group consisting of oxides, sulfides, selenides, tellurides, and polonides of elements other than those of Group VIB of the Periodic Table of the Elements (Fisher Scientific Co. Cat. No. 5-702-10, 1978). Oxides are particularly preferred as the interspathic polymeric chalcogenide. For present purposes, polymeric chalcogenides are considered to include chalcogenides of two or more repeating units, preferably three or more repeating units, say four or more or even five or more repeating units. The extent of polymerization of the interspathic polymeric chalcogenide is believed to affect the ultimate interlayer separation of the titanometallate-type layered metal oxide product.

In preparing the intercalated layered titanometallate-type layered metal oxide product material used in the catalyst composition, the interlayer separation of the layered titanometallate-type layered metal oxide material can be tailored by careful selection of the "propping" agent used to separate the layers prior to or during treatment with the interspathic polymeric chalcogenide precursors which are eventually converted to the thermally stable polymeric chalcogenide "pillars". Indeed, a wide range of interlayer separations can be achieved in preparing layered materials of the present invention. Interlayer distances can range anywhere from 2 to 30 angstroms or more, say, e.g., greater than 5, 10, 15 or 20 angstroms, depending largely on the type of "propping" agent used as well as the layered chalcogenide being treated. The titanometallate-type layered metal oxide material when intercalated contains an interspathic polymeric chalcogenide of at least one element selected from Groups IB, IIB, IIIA, IIIB, IVA, IV, VA, VB, VIA, VIIA, and VIIIA of the Periodic Table of the Elements (Fisher Scientific Co. Cat. No. 5-702-10, 1978). For example, the intercalated titanometallate-type layered metal oxide can be prepared by treating the titanometallate-type layered metal oxide which contains ion exchange sites having interspathic cations associated therewith, with an organic compound which is a cationic species or capable of forming a cationic species, to effect exchange with said interspathic cations. An electrically neutral compound capable of conversion to the interspathic polymeric chalcogenide is provided between the layers of the treated layered metal oxide. The compound is then converted to the interspathic polymeric chalcogenide to form the intercalated titanometallate-type layered metal oxide product.

The titanometallate-type layered metal oxide starting material contains ion exchange sites having interspathic cations associated therewith. Such interspathic cations may include hydrogen ion, hydronium ion and alkali metal cation. The starting material is treated with a "propping" agent comprising a source of organic cation such as organoammonium, which may include the cation itself, in order to effect an exchange of the interspathic cations resulting in the layers of the starting material being propped apart. Suitable alkylammonium cations can include n-dodecylammonium, n-heptylammonium, n-hexylammonium and n-propylammonium. The source of organic cation in those instances where the interspathic cations include hydrogen or hydronium ions may include a neutral compound such as an organic amine which is converted to a cationic analogue during the "propping" treatment. The organic cation should be capable of displacing or supplanting the original interspathic cations. In some instances, it may be desirable to remove excess propping agent which is not electrostatically bound within the layered starting material in order to permit the addition of greater amounts of polymeric chalcogenide precursor. Such removal may be effected by washing out the propping agent with a material which is soluble with said propping agent. The foregoing treatment can result in the formation of a titanometallate-type layered metal oxide of enhanced interlayer separation depending upon the size of the organic cation introduced. Contact of the layered metal oxide with the propping agent may be conducted in aqueous medium so that water is trapped between the layers of the "propped" metal oxide.

After the ion exchange, the organic-"propped" species is treated with a compound capable of forming the above-described polymeric chalcogenide. Preferably, such compounds are capable of forming the polymeric chalcogenide upon hydrolysis or other polymerizing reactions. Hydrolyzable compounds are well-suited as such compounds. It is preferred that the organic cation deposited between the layers is capable of being removed from the layered oxide material without substantial disturbance or removal of the interspathic polymeric chalcogenide. For example, organic cations such as n-octylammonium may be removed by exposure to elevated temperatures, e.g., calcination in nitrogen or air, or chemical oxidation conditions, preferably after the interspathic polymeric chalcogenide precursor has been converted to the polymeric chalcogenide in order to form the layered material product employed in the present invention.

The polymeric chalcogenide precursor-containing product can be exposed to suitable conversion conditions, such as hydrolysis and/or calcination to form the pillared titanometallate-type layered metal oxide material for the present invention. The hydrolysis step may be carried out by any suitable method, for example, by utilizing interspathic water already present in organic-"propped" titanometallate-type layered metal oxide material. Because of the effect of interspathic water on hydrolysis, the extent of hydrolysis may be modified by varying the extent to which the organic-"propped" species is dried prior to addition of the polymeric chalcogenide precursor. As noted earlier, the product after conversion to the polymeric chalcogenide form may be exposed to conditions which remove organic compounds such as the organic cation propping agents, e.g., exposure to elevated temperatures such as those encountered by calcining in air or nitrogen.

In one embodiment the titanometallate-type layered metal oxide, exclusive of its interspathic polymeric chalcogenide, has the empirical formula $$Cs_{4y}([]_yTi_{2-y})O_4$$

The catalyst composition of the present invention generally contains between about 5 to 95, preferably between about 10 to 20, weight percent of said intercalated titanometallate-type layered metal oxide and about 5 to 95, preferably about 80 to 90, weight percent of a shape-selective porous crystalline silicate material, e.g., Zeolite Y.

In a particularly useful composition for the present invention, the titanometallate-type layered metal oxide has the following additional limitations: n=3, M is $Ga^{3+}$, Z is $Ti^{4+}$, y=0 and the interspathic polymeric chalcogenide includes polymeric silica. Another useful composition for the present invention has a layered titanometallate-type layered metal oxide component wherein n=2, M is $Zn^{2+}$, Z is $Ti^{4+}$, y=0 and said interspathic polymeric chalcogenide comprises polymeric silica.

The titanometallate-type layered metal oxide may comprise about 15 to 40 weight percent of the composition of the present invention while the crystalline silicate material may comprise about 60 to 85 weight percent of said composition. The composition may also comprise an inorganic oxide binder, e.g., alumina.

Certain titanometallate-type layered metal oxides employed in the present invention are described as well as their method of preparation in U.S. application Ser. No. 879,787, filed June 27, 1986, the entire contents of which are incorporated herein by reference. Such materials are layered titanometallates comprising interspathic polymeric chalcogenide having the general formula $A_x(M_{x/n}Ti_{2-x/n})O_4$, exclusive of the interspathic polymeric chalcogenide, where A is a monovalent cation and n=1 or 2 provided that: where n=1, 0 is less than x is less than 2 and M is a trivalent cation; where n=2, 0 is less than x is less than 4 and M is a divalent cation.

The titanometallate-type layered metal oxides employed in the present invention are described in PCT/US87/01444, filed June 11, 1987. These materials are more broadly defined as a layered product comprising a layered metal oxide and pillars of an oxide of at least one element selected from Groups IB, IIB, IIIA, IIIB, IVA, IVB, VA, VB, VIA, VIIA and VIIIA of the Periodic Table of the Elements (Fisher Scientific Co. Cat. No. 5-702-10, 1978) separating the layers of the metal oxide, wherein each layer of the metal oxide has the general formula:

$$[M_x[]_yZ_{2-(x+y)}O_4]^{q-}$$

wherein M is at least one metal of valence n wherein n is an integer between 0 and 7 and preferably is 2 or 3, [] represents a vacancy site, Z is a tetravalent metal, preferably titanium, and wherein $$q=4y-x(n-4) \text{ and preferably is } 0.6\text{–}0.9,\ O<x+y<2$$

The layered intercalated product described in the preceding paragraph can be prepared by a method which comprises the steps of starting with said layered metal oxide and physically separating the layers thereof by introducing an organic cationic species between the layers at interlayer anionic sites associated with the layered oxide, introducing between the separated layers of the layered oxide a compound capable of conversion to an oxide and then converting said compound to the oxide to form oxide pillars separating adjacent layers of the layered oxide.

The pillared titanometallate-type layered metal oxide products can have a relatively high interplanar distance (d-spacing), e.g., greater than about 10 angstroms and preferably greater than 20 angstroms up to and even exceeding 30 angstroms. These materials are capable of being exposed to severe conditions such as those encountered in calcining, e.g., at temperatures of about 450° C. for about two or more hours, e.g., four hours, in nitrogen or air, without significant decrease, say, e.g., less than about 10%, in interlayer distance. Furthermore, such pillared oxides can be prepared without the severe dilution often necessary to introduce the interspathic material in prior art techniques of pillaring. Finally, the size of interspathic oxide contained within the final product can be greatly varied because the oxide precursor species is introduced in an electrically neutral form such that the amount of interspathic material incorporated within the titanometallate-type layered metal oxide is not dependent upon the charge density of the original layered oxide. Charge density should be taken into consideration in determining the suitability of the cationic species introduced between the layers in the procedure used to prop open the layers prior to pillaring.

The unpillared titanometallate-type layered metal oxide starting material contains anionic sites having interspathic cations associated therewith. Such interspathic cations may include hydrogen ion, hydronium ion and alkali metal cation.

More specifically, each layer of the titanometallate-type layered metal oxide starting material has the general formula $$[M_x[]_yZ_{2-(x+y)}O_4]^{q-}$$

wherein M is at least one metal of valence n wherein n is an integer between 0 and 7 and preferably is 2 or 3, [] represents a vacancy site, Z is a tetravalent metal, preferably titanium, and wherein $$q=4y-x(n-4) \text{ and preferably is } 0.6\text{–}0.9,\ O<x+y<2$$

Interposed between the layers of the oxide will be charge-balancing cations A of charge m wherein m is an integer between 1 and 3, preferably 1. Preferably A is a large alkali metal cation selected from the group consisting of Cs, Rb and K and M is a divalent or trivalent metal cation selected from at least one Mg, Sc, Mn, Fe, Cr, Ni, Cu, Zn, In, Ga and Al. For example, M can be both In and Ga. Structurally, these metal oxides are believed to consist of layers of $(M_x[]_yZ_{1-x-y})O_6$ octahedra which are trans edge-shared in one dimension and cis edge-shared in the second dimension forming double octahedral layers which are separated by cations in the third dimension. These materials can be prepared by high temperature fusion of a mixture of (1) metal oxide, (2) alkali metal carbonate or nitrate and (3) tetravalent metal dioxide, e.g., titanium dioxide or by fusion of a mixture of alkali metallate and tetravalent metal dioxide. Such fusion can be carried out in air in ceramic crucibles at temperatures ranging between 600° to 1100° C. after the reagents have been ground to a homogeneous mixture. The resulting product is ground to 20 to 250 mesh prior to the organic swelling and polymeric oxide intercalation steps.

Further description of layered titanometallate starting materials and their methods of preparation can be found in the following references:

Reid, A. F.; Mumme, W. G.; Wadsley, A. D. *Acta Cryst.* (1968), B24, 1228; Groult, D.; Mercy, C.; Raveau, B. *J. Solid State Chem.* 1980, 32 289; England, W. A.; Burkett, J. E.; Goodenough, J. B.; Wiseman, P.J. *J. Solid State Chem.* 1983, 49 300.

Use of these layered metal oxides as the layered starting material permits inclusion of different metal atoms into the layered starting material being treated which allows potential catalytically active sites to be incorporated in the stable layer itself. Moreover, variable amounts of metal atoms may be added to provide a catalyst with optimum activity for a particular process. Furthermore, the infinite trans-edge shared layer structure of the titanometallate-type layered metal oxides instead of the sheared 3-block structure of, for example $Na_2Ti_3O_7$, may reduce or eliminate shearing of the layers as a possible mechanism for thermal or hydrothermal decomposition of the calcined intercalated material. These titanometallate-type materials may possess even greater thermal stability than silicotitanate molecular sieves. In addition, the variable charge density on the oxide layer possible for these layered metal oxides due to the various oxidation states of metal oxides, the incorporated metal atom and the varying stoichiometry of the materials, may allow variation in the amount of the organic cationic species which can be exchanged into the material. This, in turn, permits variation of the ultimate concentration of the oxide pillars between the layers of the final product.

The titanometallate-type layered metal oxide starting material is initially treated with a "propping" agent comprising a source of organic cation, such as organoammonium cation, in order to effect an exchange of the interspathic cations resulting in the layers of the starting material being propped apart. Suitable organoammonium cations include n-dodecylammonium, n-octylammonium, n-heptylammonium, n-hexylammonium and n-propylammonium. During this propping or swelling step it is important to maintain a low hydrogen ion concentration to prevent decomposition of the titanometallate-type structure as well as to prevent preferential exchange of hydrogen ion over the propping agent. A pH range of 6 to 10, preferably 7 to 8.5 is generally employed during treatment with the propping agent. After this treatment, it has been found advantageous to wash out excess propping agent using a suitable propping agent-soluble reagent followed by washing with water. For example, n-octylamine is soluble in ethanol and hence ethanol is suitable for use with an n-octylamine propping agent. Such washing permits greater incorporation of the oxide pillar precursor in the layered metal oxide. The water treatment allows penetration of water into the interlayer spaces which assists in subsequent hydrolysis of the oxide pillar precursor.

Insertion of the organic cation between the adjoining layers serve to physically separate the layers in such a way as to make the layered material receptive to the interlayer addition of an electrically neutral, hydrolyzable, polymeric oxide precursor. In particular, alkylammonium cations have been found useful in the present invention. Thus $C_3$ and larger alkylammonium, e.g., n-octylammonium, cations are readily incorporated within the interlayer spaces of the layered metal oxide serving to prop open the layers in such a way as to allow incorporation of the polymeric oxide precursor. The extent of the interlayer spacing can be controlled by the size of the organoammonium ion employed so that use of the n-propylammonium cation can achieve an interlayer spacing of 2 to 5 angstroms whereas to achieve an interlayer spacing of 10 to 20 angstroms an n-octylammonium cation or a cation of equivalent length is required. Indeed, the size and shape of the organic cation can affect whether or not it can be incorporated within the layered structure at all. For example, bulky cations such as tetrapropylammonium are generally undesirable for use in the present method while n-alkyl ammonium cations such as those derived from n-alkyl primary amines $R_3R'N^+$ cations where R is methyl or ethyl and R' is an n-alkyl group with at least 5 carbon atoms, are preferred. Preferably treatment with the organic cationic species is conducted in aqueous media so that water is then available to hydrolyze the electrically neutral, hydrolyzable polymeric chalcogenide precursor subsequently introduced into the "propped" product.

After the ion exchange, the organic-"propped" species is treated with a compound capable of conversion, preferably by hydrolysis, to pillars of an oxide, preferably to a polymeric oxide. Where the treatment involves hydrolysis, this may be carried out using the water already present in organic-"propped" material. In this case, the extent of hydrolysis may be modified by varying the extent to which the organic-"propped" species is dried prior to addition of the polymeric oxide precursor.

It is preferred that the organic cation deposited between the layers be capable of being removed from the pillared material without substantial disturbance or removal of the interspathic polymeric oxide. For example, organic cations such as n-octylammonium may be removed by exposure to elevated temperatures, e.g., calcination, in nitrogen or air, or by chemical oxidation preferably after the interspathic polymeric oxide precursor has been converted to the polymeric oxide pillars in order to form the titanometallate-type layered metal oxide product employed in the present invention.

Interspathic chalcogenide pillars are then formed between the layers of the propped or swollen layered metal oxide starting material and may include a chalcogenide, preferably a polymeric chalcogenide, of zirconium or titanium or more preferably of a element selected from Group IVB of the Periodic Table (Fisher Scientific Company Cat. No. 5-702-10, 1978), other than carbon, i.e., silicon, germanium, tin and lead. Other suitable chalcogenides include those of Group VA, e.g., V, Nb, and Ta, those of Group IIA, e.g., Mg or those of Group IIIB, e.g., B. Most preferably, the pillars include polymeric silica. In addition, the chalcogenide pillars may include an element which provides catalytically active acid sites in the pillars, preferably aluminum.

The chalcogenide pillars are formed from a precursor material which is preferably introduced between the layers of the organic "propped" species as a cationic, or more preferably, electrically neutral hydrolyzable compound of the desired elements, e.g., those of group IVB. The precursor material is preferably an organometallic compound which is a liquid under ambient conditions. In particular, hydrolyzable compounds, e.g., alkoxides, of the desired elements of the pillars are utilized as the precursors. Suitable polymeric silica precursor materials include tetraalkylsilicates, e.g., tetrapropylorthosilicate, tetramethylorthosilicate and, most preferably, tetraethylorthosilicate. Where the pillars are also required to include a different polymeric metal oxide, e.g., alumina or titania, a hydrolyzable compound of said metal can be contacted with the organic "propped" species before, after or simultaneously with the contacting of the propped titanometallate with the silicon compound. Preferably, the hydrolyzable aluminum compound employed is an aluminum alkoxide, e.g., aluminum isopropoxide. If the pillars are to include titania, a hydrolyzable titanium compound such as titanium alkoxide, e.g., titanium isopropoxide, may be used. In addition, the chalcogenide precursor may contain zeolite precursors such that exposure to conversion conditions results in the formation of interspathic zeolite material as at least part of the chalcogenide pillars. Pillars of polymeric silica and polymeric alumina or polymeric silica and polymeric titania are particularly preferred.

After hydrolysis to produce the chalcogenide pillars and calcination to remove the organic propping agent, the final pillared product may contain residual exchangeable cations. Such residual cations in the layered material can be ion exchanged by known methods with other cationic species to provide or alter the catalytic activity of the pillared product. Suitable replacement cations include cesium, cerium, cobalt, nickel, copper, zinc, manganese, platinum, lanthanum, aluminum, ammonium, hydronium and mixtures thereof.

The products of the present invention, especially when calcined, exhibit high surface area, e.g., greater than 200, 300, 400 or even 600 $m^2/g$, and thermal and hydrothermal stability making them highly useful as catalysts or catalytic supports, for hydrocarbon conversion processes for example, cracking and hydrocracking.

In addition to pillared titanometallate-type layered metal oxide materials, the catalyst used in the process of the present invention may optionally include a porous crystalline silicate component, preferably zeolite materials and, most preferably, large pore zeolites having a Constraint Index less than about 2, as described hereinafter. For purposes of this invention, the term "zeolite" is meant to represent the class of porotectosilicates, i.e., porous crystalline silicates, that contain silicon and oxygen atoms as the major components. Other components may be present in minor amounts, usually less that 14 mole %, and preferably less than 4 mole %. These components include aluminum, gallium, iron, boron and the like, with aluminum being preferred, and used herein for illustration purposes. The minor components may be present separately or in mixtures in the catalyst. They may also be present intrinsically in the structure of the catalyst.

A convenient measure of the extent to which a zeolite provides control to molecules of varying sizes to its internal structure is the Constraint Index of the porous crystalline silicate. Porous crystalline silicates which provide a highly restricted access to and agrees from its internal structure have a high value for the Constraint Index, and zeolites of this kind usually have pores of small size, e.g., less than 5 angstroms. On the other hand, porous crystalline silicates which provide relatively free access to the internal porous crystalline silicate structure have a low value for the Constraint Index, and usually pores of large size, e.g. greater than 7 angstroms. The method by which Constraint Index is determined is described fully in U.S. Pat. No. 4,016,218, incorporated herein by reference for details of the method.

Constraint Index (CI) values for some typical large pore materials are:

| | CI (at test temperature) | |
|---|---|---|
| ZSM-4 | 0.5 | (316 ° C.) |
| ZSM-12 | 2.3 | (316° C.) |
| ZSM-20 | 0.5 | (371° C.) |
| ZSM-38 | 2 | (510° C.) |
| ZSM-50 | 2.1 | (427° C.) |
| TEA Mordenite | 0.4 | (316° C.) |
| Mordenite | 0.5 | (316° C.) |
| REY | 0.4 | (316° C.) |
| Amorphous Silica-alumina | 0.6 | (538° C.) |
| Dealuminized Y | 0.5 | (510° C.) |
| Zeolite Beta | 0.6–2.0 | (316° C.–399° C.) |

The above-described Constraint Index is an important and even critical definition of those porous crystalline silicates which are useful in the instant invention. The very nature of this parameter and the recited technique by which it is determined, however, admit of the possibility that a given porous crystalline silicate can be tested under somewhat different conditions and thereby exhibit different Constraint Indices Constraint Index seems to vary somewhat with severity of operations (conversion) and the presence or absence of binders. Likewise, other variables, such as crystal size of the zeolite, the presence of occluded comtaminants, etc., may affect the Constraint Index. Therefore, it will be appreciated that it may be possible to so select test conditions, e.g., temperature, as to establish more than one value for the Constraint Index of a particular porous crystalline silicate. This explains the range of Constraint Indices for some zeolites, such as zeolite beta.

It is to realized that while the above CI values typically characterize the specified porous crystalline silicates, such values are the cumulative result of several variables useful in the determination and calculation thereof. Thus, for a given zeolite exhibiting a CI value of about 2 or less, depending on the temperature employed during the test method within the range of 290° C. to about 538° C., with accompanying conversion between 10% and 60%, the CI may vary. Likewise, other variables such as the crystal size of the porous crystalline silicate, the presence of possibly occluded contaminants and binders intimately combined with the zeolite may affect the CI. It will accordingly be understood to those skilled in the art that the CI, as utilized herein, while affording a highly useful means for characterizing the porous crystalline silicates of interest is approximate, taking into consideration the manner of its determination, with the possibility, in some instances, of compounding variable extremes. However, in all instances, at a temperature within the above-specified range of 290° C. to about 538° C., the CI will have a value for any given porous crystalline silicate of interest herein of about 2 or less, preferably about 1 or less.

The large pore zeolites, i.e., those zeolites having a Constraint Index of about 2 or less, are well known to the art and have a pore size sufficiently large to admit the vast majority of components normally found in a feed chargestock. The zeolites are generally stated to have a pore size in excess of 7 angstroms and are represented by zeolites having the structure of, e.g., zeolite beta, Zeolite Y, Zeolite X, Ultrastable Y (USY), Dealuminized Y (Deal Y), REY, L, Mordenite, TEA Mordenite, UHP-Y, ZSM-4, ZSM-12, ZSM-18, ZSM-20, ZSM-38, ZSM-50, LZ-210, LZ-210-M, LZ-210-T, and LZ-210-A. A zeolite well known in the art and useful in the present invention is faujasite. The ZSM-20 zeolite resembles faujasite in certain aspects of structure, but has a notably higher silica/alumina ratio than faujasite, as does Deal Y.

Some of these large pore zeolites are more particularly described in U.S. Pat. Nos. 3,308,069 and Reissue 28,341 (zeolite beta); 3,923,639 (ZSM-4); 3,832,449 (ZSM-12); 3,950,496 (ZSM-18); 3,972,983 (ZSM-20); 4,640,849 (ZSM-50); 3,293,192 and 3,449,070 (USY); 3,442,795 (Deal Y); 4,401,556 (UHP-Y) and 4,534,853 (LZ-210, LZ-210-M, LZ-210-T, and LZ-2l0A) respectively, the entire contents of which are incorporated by reference.

As a general rule, the process of the present invention can be utilized with any conventional catalytic cracking unit such as a conventional moving bed reactor or a fluid bed catalytic cracking reactor (FCC unit). In a typical FCC unit, hot catalyst of about 640° to 730° C. is mixed with relatively cold oil feedstock at about 105° to 390° C. The catalyst is the heat transfer medium for vaporizing and superheating the oil feedstock to a temperature suitable for the desired cracking reaction (500°–560° C.). Additional details as to the construction and operation of fluidized catalytic cracking are disclosed in U.S. Pat. Nos. 3,152,065 (Sharp et al.); 3,261,776 (Banman et al); 3,654,140 (Griffel et al.); 3,812,029 (Snyder); 4,093,537 (Gross et al.); 4,118,337 (Gross et al.); 4,118,338 (Gross et al.); 4,218,306 (Gross et al.); 4,444,722 (Owen); 4,459,203 (Beech et al.); 4,578,183 (Chou et al.); as well as in Venuto et al., Fluid Catalytic Cracking With Zeolite Catalysts, Marcel Dekker, Inc. (1979). The entire contents of all of the above patents and publication are incorporated herein by reference in their entirety.

The process of the invention can be utilized with any conventionally-used catalytic cracking feeds including naphthas, gas oils, vacuum gas oils, residual oils, light and heavy distillates and synthetic fuels. The process is particularly adaptable for the selective production of gasoline range materials, especially from the heavier feeds such as residuals due to the relatively large spacing between the layers of the metal oxide catalyst. With the process of the present invention for catalytic cracking, increased yield of gasoline results as compared with the use of conventional cracking catalysts with the increased gasoline yield at the expense of gas make. Furthermore, the process is capable of handling resins where the catalyst preferentially converts the heaviest components.

FIGS. 1–4 are graphical representations for comparison purposes of the results of a number of runs in the catalytic cracking of petroleum fractions using various catalysts. The catalysts used in these runs were titanometallate of the layered oxide type as described hereinafter, a REY zeolite and an amorphous silica-alumina.

The following examples illustrate additional specific manners in which to prepare the layered oxide of the titanometallate-type intercalated with an interspathic chalcogenide as was described in general terms previously.

EXAMPLE 1

Preparation of a Silica-Pillared Titanozincate

The silica-pillared titanozincate material was prepared as follows:

$K_2CO_3$, ZnO and $TiO_2$ were thoroughly ground to form a homogeneous mixture having the stoichiometric $K_{0.80}(Zn_{0.40}Ti_{1.60})O_4$ which was then fired in air in a ceramic crucible at 900° C. for 200 minutes and then at 1050° C. for 720 minutes. The product was then reground and refired under the same conditions. The resulting stiff powder was then ground to about 100 mesh to yield a product analyzed as $K_{0.66}(ZN_{0.35}Ti_{1.49})O_4$. The d-layer spacing from X-ray powder diffraction d(A) was measured as 7.83. Excess octylamine (5 mole equiv/mole equiv of titanozincate) was slowly added to a solution of 12% HCl (49 equiv HCl/mole) while keeping the temperature of the reaction mixture below 50° C. to form an aqueous octylammonium chloride solution. The titanozincate was then added to the chloride solution and the mixture was heated to reflux for 24 hours. The reaction mixture was cooled, filtered and washed with hot distilled water. The air dried product was a material having the composition $$H_3O_{0.33}{}^{+}K_{0.03}(NH_3R^{30})_{0.56}[Zn_{0.46}Ti_{1.75}]O_4$$

containing 2.68 weight percent N and having a 24.6 A d-layer spacing from the lowest two theta peak in its X-ray diffraction pattern. The formula was calculated from analytical data obtained for the materials, assuming that the $H_3O^+$ of the interlayer can be derived by subtraction of the total cation content (alkali metal plus octylammonium) from that required to balance the charge on the $(M,Ti)_2O_4{}^{n-}$ layers due to incorporation of the transition metal cation. A low $H^+$ concentration was maintained during octylammonium exchange to avoid decomposition of the titanometallate structure.

The octylammonium-exchanged product was then stirred in EtOH for 2 hours, filtered, and air dried at room temperature for 2 hours. The product was then slurried with $H_2O$ using a blender to ensure maximum mixing of the hydrophobic solid with water. The slurry was then transferred to a beaker and stirred overnight. The mixture was filtered and air dried for 4 hours.

The resulting filter cake was treated with tetraethylorthosilicate (TEOS) (5 g TEOS/g solid) for 72 hours. The pillared material was obtained by filtering this slurry and drying the solid in air. Calcination of the pillared material at 500° C. for about 4 hours in air eliminated octylamine and produced a silica-pillared titanozincate.

EXAMPLE 2

Preparation of a Silica-Pillared Titanogallate (a) Solid State Preparation of Precursor.

$Ga_2O_3$ (25.00 g, 0.133 mole), $TiO_2$ (31.95 g, 0.399 mole), and $Cs_2CO_3$ (43.43 g, 0.133 mole) were thoroughly mixed and ground to a homogeneous mixture. The mixture was fired at 910° C. for 12 h after heating to 150° C. for 2 h and 500° C. for 4 h to decompose the reactants. Temperature ramps of 5° C./min were used. After firing, the product was cooled and ground. The x-ray powder diffraction pattern indicated that the product was a mixture of the layered titanometallate phase and an additional material, possibly beta-$Ga_2O_3$. Analysis of the material gave the following composition: 34% Cs, 24.4% Ga, 20.3% Ti, 99.07% ash.

(b) Swelling with Octylammonium Ion

Concentrated HCl (66.65 g, 0.6912 mole) was diluted to 250 ml with $H_2O$. Octylamine (91.04 g, 0.7052 mole) was added slowly. Forty grams of the sample from (a) were added and the solution was heated to reflux with stirring for 48 h. The solution was filtered, washed with 1500 ml hot $H_2O$ and dried in air. The powder x-ray diffraction pattern from 2°–20° 2 theta was obtained and indicated a d-spacing of 23.2 A in the solid.

This material (45.0 g) was stirred in 150 ml EtOH for 2 h, filtered, and air dried. The air dried sample was slurried in 300 ml $H_2O$ using a blender to ensure complete wetting of the hydrophobic solid. The slurry was transferred to a beaker and stirred overnight, then filtered and air dried.

(c) Treatment with Tetraethylorthosilicate (TEOS)

The solid from (b) was reslurried in 700 ml $H_2O$ for 2 h, filtered and air dried immediately prior to treatment with TEOS to ensure that the interlaminar water was present. The solid (36.94 g) was stirred in 185.0 g TEOS at 80° C. for 24 h. The reaction was carried out under an $N_2$ environment to control the humidity. The reaction mixture was filtered and the solid dried in air to yield 39.66 g (7.4% weight uptake). The process was repeated; however, no weight gain was observed on the second treatment of this sample.

(d) Calcination to Produce a Molecular Sieve

The final product was obtained by calcining the sample at 500° C. in $N_2$ for 1 h followed by 2 h in air. A 20.5% weight loss was observed during the final calcination. A powder x-ray diffraction pattern of the material showed a low angle at 3.9° 2 theta, indicating a basal spacing of 22.83 A and an interlayer separation of about 15.8 A assuming no degradation of the layer structure upon calcination. Chemical analysis of the material indicated the following composition: 9.47% Ga, 26.5% $SiO_2$, 21.3% Ti, 0.34% Cs, 98.00% ash. The porous solid had a surface area of 266m$^2$/g and absorbed 12.0 wt.% $H_2O$, 8.2 wt.% cyclohexane and 7.3 wt. % n-hexane.

EXAMPLE 3

Pillaring of Vacancy Titanate

In this example, the layered starting material was a titanate having the empirical formula $Cs_{0.7}Ti_{1.82}O_4$. This material contains vacancies at certain titanium sites in the layers and so can be described by the general formula $Cs_{4y}([]_yTi_{2-y})O_4$ wherein [] is a vacancy site and y is 0.18.

The layered vacancy titanate was prepared by the high temperature solid state reaction of $Cs_2CO_3$ and $TiO_2$ in the stoichiometry of 1:5.2. The $Cs_2CO_3$ employed was ground to fine powder (less than 100 mesh) dried and stored in a vacuum oven at 180° C. The $TiO_2$ employed was used as received. The solids (50g $Cs_2CO_3$ and 63.93g $TiO_2$) were ground to a homogenous mixture which was fired at 650° C. for 10 hours and, after regrinding, was then fired at 950° C. for a further 10 hours. The resultant product was then ground.

30g of the titanate product was then swollen by replacing the octylamine/HCl (mole ratio 1 titanate: 5 octylamine:4.9HCl) for 14 hours. After washing with 1000 ml of water, the product was dried in air overnight.

25g of the swelled titanate was stirred in 300 ml ethanol, filtered and air dried. The dried solid was then slurried in 500 ml water for 24 hours, pillared and air dried overnight. The resultant solid (16.4g) was stirred with 100g of TEOS for 24 hours and the mixture was filtered and air dried to yield 18.5 g of solid product. The required porous molecular sieve was obtained by calcining the product in air at 500° C. for 4 hours.

The process of the invention is illustrated further in the following examples.

EXAMPLE 4 Preparation of a Pillared Titanometallate

A layered titanometallate having silica pillars was prepared for use in the catalytic cracking of petroleum fractions. The layered precursor for the catalyst was prepared by high temperature solid state reaction of $Cs_2CO_3$ and $TiO_2$ in the stoichiometry of 1:5.2 ($Cs_{0.07}[]_{0.18}Ti_{1.82}O_4$). $Cs_2CO_3$ (AESAR) was ground to a fine powder (about 100 mesh) then dried and stored in a vacuum oven at 180° C. The solids (100.00 g of $Cs_2CO_3$ and 127.87 g $TiO_2$) were ground to a homogeneous mixture which was fired at 650° C. for 600 minutes followed by an additional 600 minutes at 650° C. after regrinding. The material was ground after firing.

An aqueous slurry of 30% solids was ball-milled for 6 hours. Cesium cations were removed from 200.0 g of the ball milled solid by triple refluxing in 1M $NH_4NO_3$ with filtering and washing with hot $H_2O$ after each exchange. The material was air dried after the final exchange. Analysis of this preparation indicated that 3300 ppm of $Cs^+$ remained in the sample.

The solid was then swollen by refluxing in octylamine (4.1 g octylamine/g solid) for 24 hours using a Dean-Stark trap in the condensation column to remove $H_2O$ from the system. After washing with 500 ml 95% EtOH, the product was dried in air to yield 187.47 g of a waxy solid.

Insertion of the silica pillars between layers was accomplished utilizing alternate multiple tetraethylorthosilicate (TEOS)/$H_2O$ treatments. The octylamine swollen product was treated with TEOS directly after octylamine treatment. The solids were stirred in TEOS (5 g TEOS/g solid), while maintaining the reaction temperature at 80° C. under a slight flow of $N_2$ (0.5 scf/h) for 24 hours. The product was filtered and air dried. The solid was slurried in water for about four hours, filtered and air dried. The $H_2O$/TEOS treatments were repeated twice.

A porous titanometallate catalyst was obtained by calcination at 500° C. for 4 hours using a heating rate of 3° C./min. The resultant pillared vacancy titanometallate catalyst had the properties shown in the following table.

TABLE 1

| Properties of the Pillared Titanometallate Catalyst | |
|---|---|
| Surface Area, $m^2/g$ | 615 |
| Density,g/cc | |
| Real | 2.700 |
| Particle | 0.979 |

TABLE 1-continued

| Properties of the Pillared Titanometallate Catalyst | |
|---|---|
| Packed | 0.863 |
| Pore Volume, cc/g | 0.651 |
| Sorption Capacities, wt. % | |
| n-$C_6$, p= 40 torr | 18.8 |
| cy$C_6$, p= 40 torr | 18.7 |
| $H_2O$, p= 12 torr | 25.3 |
| Titanium, wt. % | 21.7 |
| $SiO_2$, wt. % | 48.8 |
| Cesium, ppm | 1750 |
| Ash, wt. % | 97.5 |
| Alpha | 2.1 |

Procedures for determining the alpha value of the composition are described in U.S. Pat. No. 3,354,078 to Miale et al.; J. Catalysis, Vol. 4, p. 527 (1965); J. Catalysis, Vol. 6, p. 278 (1966); J. Catalysis, Vol. 61, p. 395 (1980); all of which are incorporated herein by reference. Preferably, the alpha value is determined at a fixed temperature of about 538° C. Generally, compositions used in the process of the subject invention have an alpha value of 0.5 to about 100, preferably about 1 to 50, most preferably about 1 to 20.

EXAMPLE 5 Catalytic Cracking of a Petroleum Fraction

The catalyst made in accordance with Example 4 was then used to catalytically crack a residual petroleum fraction. A 32 g sample of the titanometallate material was pelleted and sieved to 80/120 mesh and loaded into an automated fluidized dense bed reactor unit. This catalyst material was then used in a series of runs to crack a paraffinic Statford atmospheric resid. The properties of the atomospheric resid are given in Table 2.

TABLE 2

| Properties of Statfjord Atmospheric Resid | | |
|---|---|---|
| Pour Point, °F. | | 100 |
| K.V. cs, 40 ° C. | | too waxy |
| K.V. cs, 100 ° C. | | 13.11 |
| CCR, wt. % | | 3.53 |
| Density g/cc, 70 ° C. | | 0.8812 |
| Carbon, wt. % | | 85.4 |
| Sulfur, wt. % | | 0.63 |
| Nitrogen, ppm | | 1300 |
| Hydrogen, wt. % | | 12.5 |
| Ni, ppm | | 1.4 |
| V, ppm | | 2.9 |
| Fe, ppm | | 5.2 |
| Na, ppm | | 5.0 |
| Pct Non-Aromatics | | 51.3 |
| Pct Aromatics | | 48.7 |
| Distillation | | |
| (vol % Distilled) | IBP, °F. | 419 |
| | 5% | 572 |
| | 10% | 631 |
| | 30% | 757 |
| | 50% | 838 |
| | 70% | 911 |
| | 80% | 1005 |
| | 90% | 1140 |
| | Pct. Recov | 99% |

In each run, typical cracking conditions were 950° F. atmospheric pressure, cat/oil [32 1.2 to 7 and WHSV [32 1 to 9 $hr^{-1}$. The product distributions from these runs are summarized in Table 3.

TABLE 3

| Conversion of Statfjord Long Resin by Titanometallate | | | | | |
|---|---|---|---|---|---|
| Run Number | Feed | 1 | 2 | 3 | 4 |
| Temperature, °C. | | 510 | 510 | 510 | 510 |
| Cat/Oil | | 2.0 | 1.3 | 2.0 | 1.0 |
| WHSV,hr −1 | | 6 | 9.2 | 6 | 12 |
| Grams of Oil Fed | | 85.7 | 79.3 | 81.4 | 118.4 |
| cc of Oil Fed | | 96.4 | 89.2 | 91.6 | 133.0 |
| No. of Cycles | | 10 | 7 | 11 | 8 |
| Mass balance | | 99.3 | 95.0 | 95.6 | 98.2 |
| Product Analysis, wt. % | | | | | |
| $H_2 + H_2S$ | | 1.28 | 1.16 | 1.26 | 0.71 |
| $C_1$, | | 1.43 | 1.97 | 1.36 | 1.02 |
| $C_2$s | | 2.90 | 2.35 | 2.69 | 1.64 |
| $C_3$ | | 3.16 | 1.37 | 1.80 | 1.12 |
| $C_3$= | | 4.95 | 3.34 | 4.25 | 3.23 |
| i-$C_4$ | | 4.09 | 1.67 | 2.26 | 2.14 |
| N—$C_4$ | 0.88 | 0.46 | 0.59 | 0.39 | |
| $C_4$=,s | | 3.27 | 1.80 | 2.69 | 2.26 |
| $C_5$ - 330° F. | | 32.37 | 35.10 | 32.74 | 30.07 |
| 330°- 420° F. | | 8.24 | 9.01 | 8.46 | 9.73 |
| 420°- 650° F. | 10.1 | 13.00 | 19.32 | 17.09 | 19.93 |
| 650°- 850° F. | 33.9 | 3.29 | 6.24 | 7.19 | 13.04 |
| 850°- 1050° F. | 39.0 | 1.07 | 0.25 | 0.74 | 1.02 |
| % Coke | | 21.07 | 15.84 | 16.88 | 13.70 |
| Product Selectivities (Based on Conversion to 650° F.) | | | | | |
| $C_1 + C_2$ | | 5.17 | 5.18 | 4.94 | 3.41 |
| $C_4^-$ | | 26.26 | 16.93 | 20.62 | 16.07 |
| $C_5$ to 330° F. | | 38.70 | 42.09 | 39.94 | 38.64 |
| $C_5$ to 42−° F. | | 48.55 | 52.90 | 50.26 | 51.14 |
| 420° to 650° F. | | 3.47 | 11.06 | 8.53 | 19.11 |
| Coke | | 25.19 | 19.11 | 20.59 | 17.60 |
| Conversion to 650° F.− | | 86.54 | 83.39 | 81.97 | 77.83 |
| Conversion to 420° F.− | | 83.64 | 74.17 | 74.98 | 68.01 |
| Conversion to 330° F.− | | 75.40 | 65.16 | 66.52 | 58.27 |
| Crackability,conv/(1-conv) | | 5.11 | 2.87 | 3.00 | 2.13 |

In this table and in the following examples, the conversions were calculated on a net 420° F. basis, i.e., 420° F.− conversion=wt. % 420° F.− in product+wt. % coke. Product analyses were carried out by conventional FID-GC. The boiling range distribution of the liquid products was determined by the ASTM D28887 simulated distillation technique.

Figure 2:
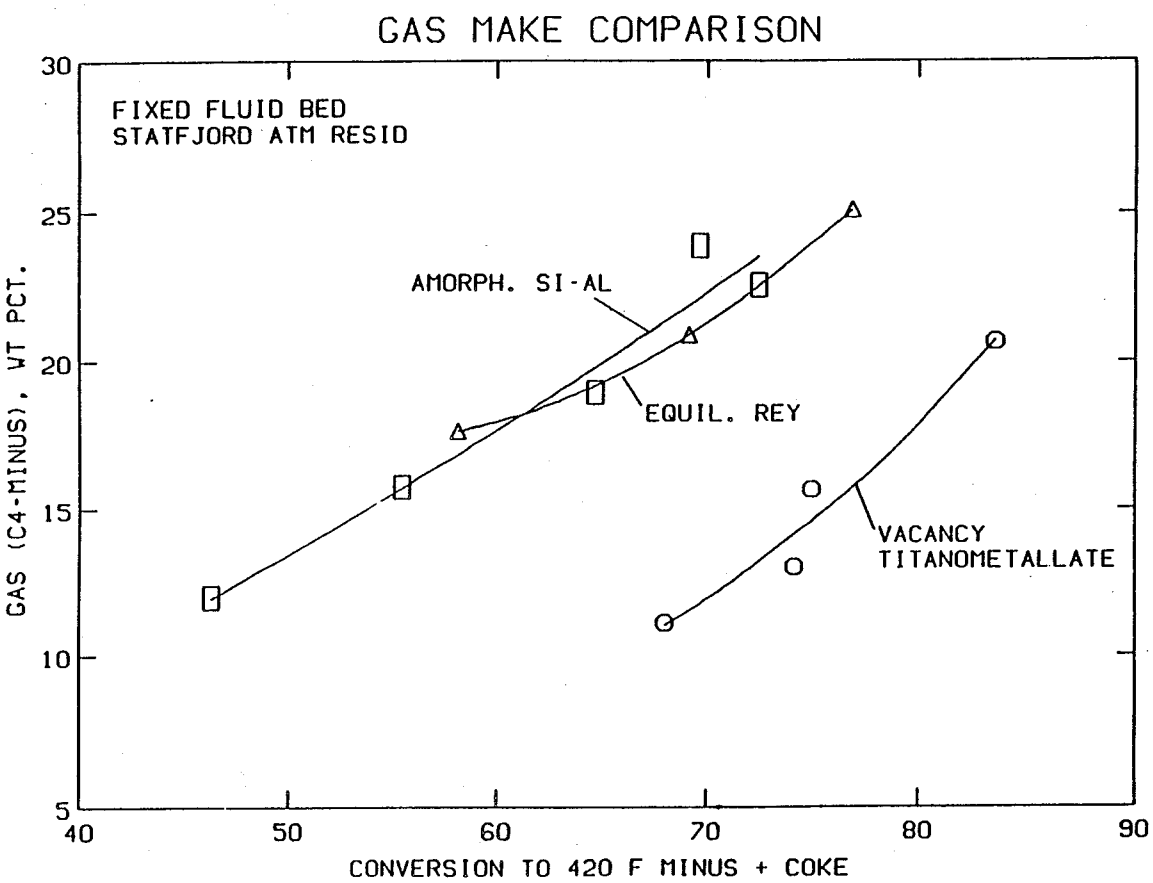
Figure 3:
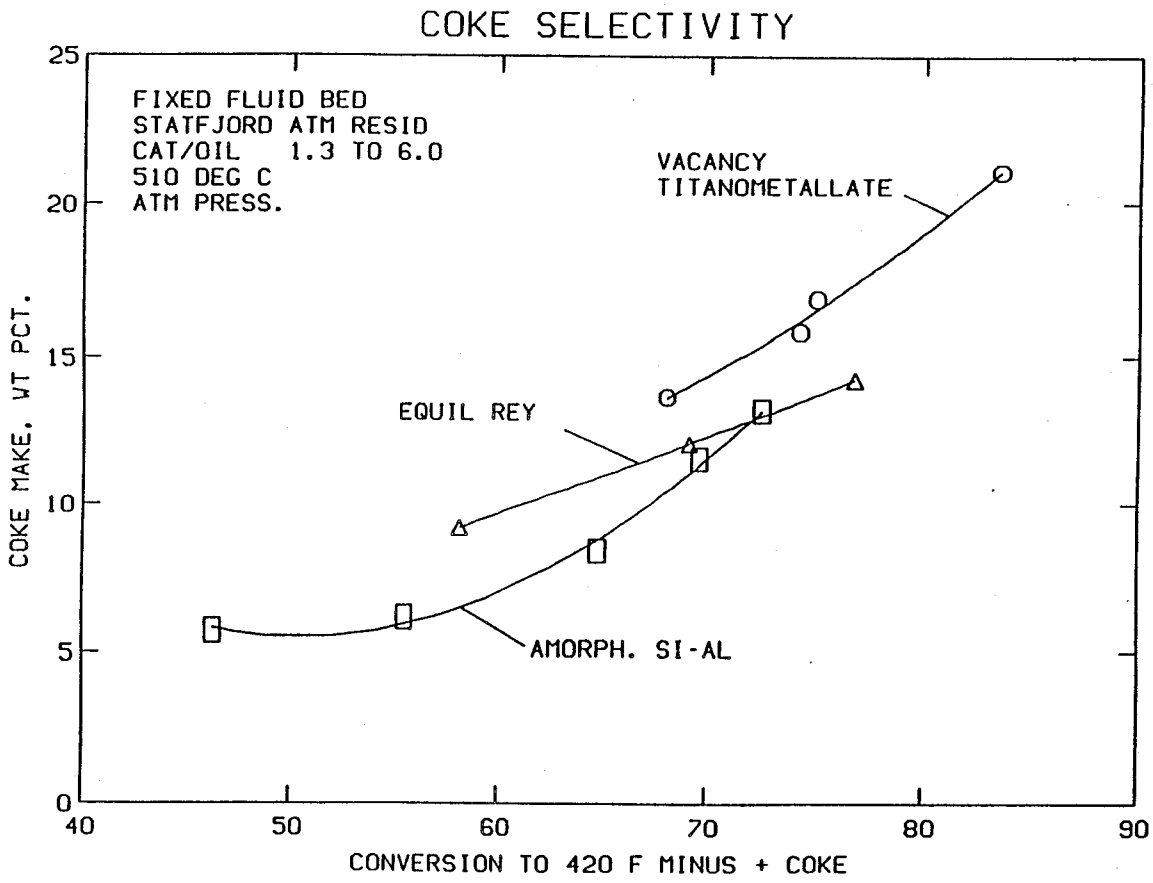
Figure 4:
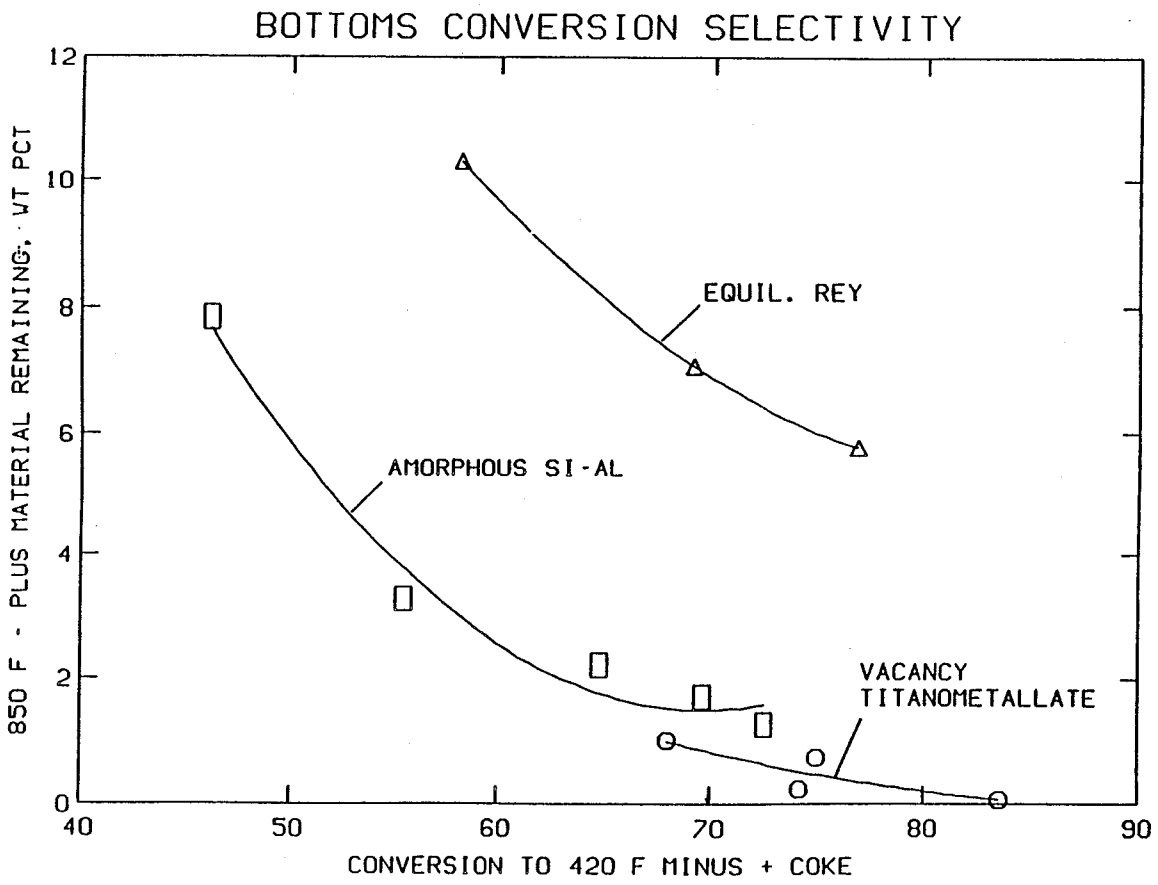

The results of the above runs are presented graphically in FIGS. 1 through 4, FIG. 1 being gasoline selectivity, FIG. 2 being gas make, FIG. 3 being coke selectivity and FIG. 4 being bottoms conversion selectivity.

The above results obtained in the catalytic racking process according to the invention were then compared to the results obtained using more conventional type cracking catalysts with the same essentially feedstock and processing conditions.

EXAMPLE 6

Catalytic Cracking with a REY Zeolite

One catalyst compared was a commercially obtainable equilibrium Rare Earth Y (REY) zeolite in a silica-alumina matrix typically used in FCC units. This catalyst had the properties shown in Table 4.

TABLE 4

| Properties of the Rey Catalyst | |
|---|---|
| Ash at 1000° C., wt. % | 97.3 |
| Packed Density, g/cc | 0.96 |
| Loose Density, g/cc | 0.87 |
| Real Density, g/cc | 2.78 |
| Particle Density, g/cc | 1.37 |
| Pore Volume, cc/g | 0.37 |
| Surface Area, $m^2/g$ | 113.0 |
| Carbon on Catalyst, wt. % | 0.17 |
| Alumina, wt. % | 43.2 |
| Silica, wt. % | 53.0 |

TABLE 4-continued

| Properties of the Rey Catalyst | |
|---|---|
| Total Rare Earths as $RE_2O_3$, wt.% | 2.95 |
| REY, % by X-ray | 14.90 |
| Nickel, ppm | 470 |
| Vanadium, ppm | 1460 |
| Antimony, ppm | 29 |
| Iron, ppm | 5 |
| Copper, ppm | 80 |
| Particle Size Dist | |
| 0 to 20 micron, wt. % | 0.0 |
| 20 to 40 micron, wt. % | 7.1 |
| 40 to 60 micron, wt. % | 35.8 |
| 60 to 80 micron, wt. % | 32.1 |
| 80+ microns, wt. % | 25.0 |

A 50 gram sample of the above catalyst was loaded into the same automated fixed fluidized bed unit used in Example 5. This catalyst was then used in a series of runs to crack the Statfjord atmospheric resid described in Table 2. Cracking conditions were virtually identical to those used in Example 5 (950° F., atmospheric pressure, cat/oil=1.2 to 7). The results of the product produced by this catalyst are summarized in FIGS. 1–4.

EXAMPLE 7

Catalytic Cracking with Silica-Alumina

The second comparison catalyst was an amorphous $SiO_2$-$Al_2O_3$ cracking catalyst produced by spray drying an 87 wt. % $SiO_2$/13 wt. % $Al_2O_3$ mixture, calcining the catalyst at 1000° F., exchanging the catalyst twice with a 1 M solution of $NH_4NO_3$ and then calcining the catalyst a second time at 1000° F. The catalyst had the properties shown in Table 5.

TABLE 5

| Properties of the Amorphous $SiO_2$—$Al_2O_3$ Catalyst | |
|---|---|
| Surface Area, $m^2/g$ | 363 |
| Density, g/cc | |
| Real | 2.277 |
| Particle | 1.069 |
| Packed | 0.96 |
| Pore Volume, cc/g | 0.496 |
| Avg. Pore Diameter, A | 54 |
| Sodium, ppm | 125 |
| Alpha | 1.8 |

A 30 gram sample of the amorphous $SiO_2$-$Al_2O_3$ catalyst was loaded into the same fixed fluidized bed unit used in Example 5. This catalyst was then used in a series of runs to catalytically crack the Statfjord atmospheric resid described in Table 2. Cracking conditions were virtually identical to those used in Example 5 (950° F., atmospheric pressure, cat/oil=1.2 to 7). The overall results of these runs are shown graphically in FIGS. 1–4.

A review of the product gasoline, coke and gas sensitivities of FIGS. 1–4 illustrates the advantages of the process of the invention in utilizing titanometallates as cracking catalysts. FIG. 1 shows that the pillared vacancy titanometallate produces 4 to 5 wt. % more gasoline than either the fresh amorphous $Si_2O2$-$Al_2O_3$ catalyst or the equilibrium REY catalyst. FIGS. 2 and 3 shown that the increase in the amount of gasoline produced by the titanometallate is principally at the expense of gas. FIG. 4 also shows that the titanometallate converts the heavy fraction (850° F.) more effectively than either the amorphous $SiO_2$-$Al_2O_3$ catalyst or the equilibrium REY catalyst.

While there has been shown and described what is considered to be preferred embodiments of the present invention, it will be obvious to those skilled in the art that various changes and modifications may be made herein without departing from the invention as defined in the appended claims.

It is claimed:

1. A process for catalytically cracking a petroleum fraction to lighter hydrocarbons, the process comprising providing a feedstock containing a petroleum fraction and then contacting said feedstock with a catalyst under catalytic cracking conditions, the catalyst composition including a titanometallate layered metal oxide material comprising a layered metal oxide material comprising a layered metal oxide and pillars of a chalcogenide of at least one element selected from Groups IB, IIB, IIIA, IIIB, IVB, VA, VB, VIA, VIIA and VIIIA of the Periodic Table of the Elements separating the layers of the metal oxide, wherein each layer of the metal oxide has the general formula $$[M_x[]_yZ_{2-(x+y)}O^4]^{q-}$$

wherein M is at least one metal of valence n wherein n is an integer between 0 and 7, [] represents a vacancy site, Z is titanium, and wherein $$q=4y-x(n-4)$$

$$0<x+y<2$$

so as to produce lighter hydrocarbons.

2. The process of claim 1, wherein n is 2.

3. The process of claim 1, wherein n is 3.

4. The process of claim 1, wherein y is greater than zero.

5. The process of claim 1, wherein q is from 0.6–0.9.

6. The process of claim 1, wherein M is selected from the group consisting of Mg, Sc, Mn, Fe, Cr, Ni, Cu, Zn, In, Ga and Al.

7. The process of claim 5, wherein M is selected from the group consisting of Ga and In.

8. The process of claim 5, wherein M is selected from the group consisting of Fe, Ni and Zn.

9. The process of claim 1, wherein the pillars comprise a polymeric oxide.

10. The process of claim 1, wherein the pillars comprise polymeric silica.

11. The process of claim 1, wherein said catalyst composition further contains porous crystalline silicate material having a Constraint Index of about 2 or less.

12. The process of claim 11, wherein said composition contains between about 10 to 20 weight percent of said titanometallate layered metal oxide and up to about 80 weight percent of said porous crystalline silicate material.

13. The process of claim 9, wherein said polymeric oxide comprises polymeric silica and polymeric alumina.

14. The process of claim 9, wherein said polymeric oxide comprises polymeric silica and polymeric titania.

15. The process of claim 11, wherein said porous crystalline silicate is a zeolite selected from the group consisting of ZSM-4, ZSM-12, ZSM-18, ZSM-20, ZSM-50, zeolite beta, Zeolites X, Y, L, LZ-210 and Mordenite.

16. The process of claim 11, wherein said porous crystalline silica is a zeolite selected from the group consisting of ZSM-4, ZSM-12, ZSM-18, ZSM-20, ZSM-50 and zeolite beta.

17. The process of claim 16, wherein M is Ga and said chalcogenide is polymeric silica.

18. The process of claim 16, wherein M is Zn and said pillars comprise polymeric silica.

19. The process of claim 18, wherein said titanometallate layered metal oxide comprises at least about 15 weight percent of said catalyst composition and said porous crystalline silicate material comprises at least about 60 weight percent of said composition.

20. The process of claim 1, wherein said composition comprises an inorganic oxide binder.

21. The process of claim 20, wherein said binder is alumina.

22. The process of claim 1, wherein x is zero.

23. The process of claim 4, wherein y is greater than 0.1

24. The process of claim 10, wherein x is zero, y is greater than 0.1 and said petroleum fraction is a residual petroleum fraction.

25. The process of claim 1, wherein the catalytic-cracking condtions include a temperature of at least 400° C.

* * * * *

UNITED STATES PATENT AND TRADEMARK OFFICE

CERTIFICATE OF CORRECTION

PATENT NO. : 4,895,638

DATED : January 23, 1990

INVENTOR(S) : Brent A. Aufdembrink et al

It is certified that error appears in the above-identified patent and that said Letters Patent is hereby corrected as shown below:

Col. 11, line 35, change "$R^{30}$" to --$R^{+}$--

Signed and Sealed this

Twentieth Day of August, 1991

*Attest:*

HARRY F. MANBECK, JR.

*Attesting Officer*

*Commissioner of Patents and Trademarks*